US009705240B2

(12) United States Patent
Benham et al.

(10) Patent No.: US 9,705,240 B2
(45) **Date of Patent: *Jul. 11, 2017**

(54) VIBRATION RESISTANT CONNECTOR

(71) Applicant: Winchester Electronics Corporation, Middlebury, CT (US)

(72) Inventors: John E. Benham, Torrington, CT (US); David J. Camelio, Foxboro, MA (US)

(73) Assignee: Winchester Electronics Corporation, Middlebury, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/157,864

(22) Filed: May 18, 2016

(65) Prior Publication Data

US 2017/0077642 A1 Mar. 16, 2017

Related U.S. Application Data

(63) Continuation-in-part of application No. 14/851,915, filed on Sep. 11, 2015, now Pat. No. 9,553,400.

(51) Int. Cl.

| | |
|---|---|
| ***H01R 13/64*** | (2006.01) |
| ***H01R 13/533*** | (2006.01) |
| ***H01R 4/18*** | (2006.01) |
| ***H01R 13/52*** | (2006.01) |
| ***H01R 13/6477*** | (2011.01) |
| ***H01R 24/44*** | (2011.01) |

(52) U.S. Cl.
CPC ..... *H01R 13/533* (2013.01); *H01R 4/18* (2013.01); *H01R 13/5205* (2013.01); *H01R 13/6477* (2013.01); *H01R 24/44* (2013.01)

(58) Field of Classification Search
CPC ..... H01R 13/6315; H01R 33/00
USPC .... 439/248, 247, 559, 560, 277, 588, 92, 94
See application file for complete search history.

(56) References Cited

U.S. PATENT DOCUMENTS 8,047,872 B2 11/2011 Burris et al.

OTHER PUBLICATIONS

U.S. Appl. No. 14/851,915—Preliminary Claim amendment of Aug. 3, 2016.*
Office Action issued on May 3, 2016, in U.S. Appl. No. 14/851,915, 7 pages.

* cited by examiner

*Primary Examiner* — Phuongchi T Nguyen
(74) *Attorney, Agent, or Firm* — Rothwell, Figg, Ernst & Manbeck, P.C.

(57) ABSTRACT

A vibration resistant connector is disclosed. The connector employs a friction member to create a resistance between a coupling nut of the connector and a connector body of the connector that is disposed in a cavity formed by the coupling nut. In some embodiments, the friction member is in the form of an O-ring that encircles a portion of the connector body and that is compressed by the coupling nut.

8 Claims, 5 Drawing Sheets

VIBRATION RESISTANT CONNECTOR

CROSS-REFERENCE TO RELATED APPLICATION(S)

This application is a continuation-in-part of U.S. application Ser. No. 14/851,915, filed on Sep. 11, 2015, which is incorporated by reference.

TECHNICAL FIELD

This disclosure is related to the field of vibration resistant connectors.

BACKGROUND

In a vibratory environment, such as an aircraft, train, truck or other moving vehicle, a lock wire is commonly used to secure a coupling nut of a connector and, thereby, keep the connector in a mated state. Lock wires are placed through small holes drilled into the coupling nut of the connector then secured to a structure (e.g., an airframe). Attaching lock wires to the coupling nut and then to the airframe is difficult, time consuming, and contributes scrap material that may migrate into critical areas of the vehicle. Accordingly, the use of lock wires should be avoided whenever possible.

SUMMARY

This disclosure provides a vibration resistant connector that can be used in vibratory environments without the need of lock wires for keeping the connector in a connected state during use.

The above and other aspects and embodiments are described below.

DETAILED DESCRIPTION

Figure 1:
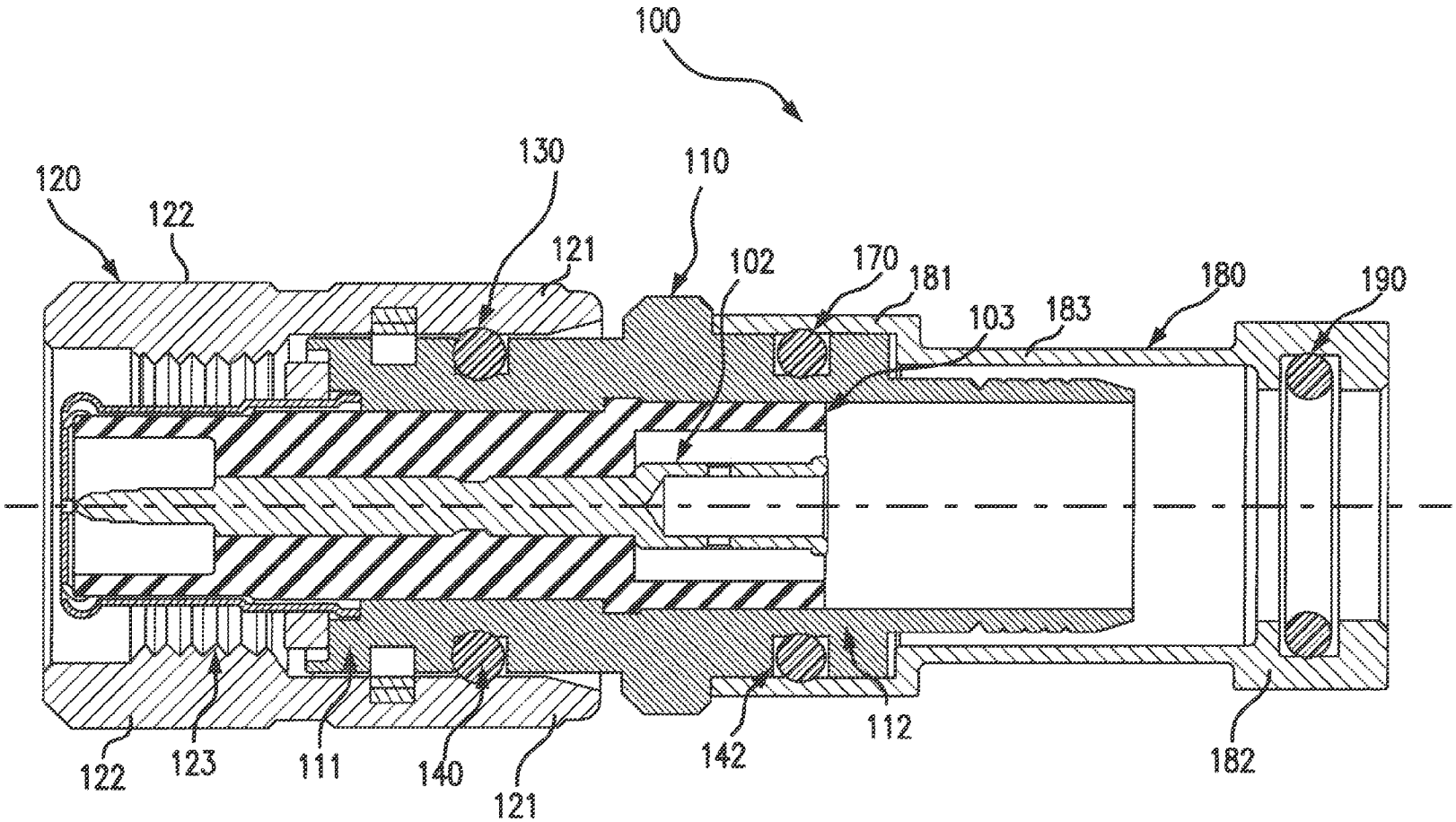
FIG. 1 is a cross-sectional view of a vibration resistant connector according to some embodiments.

FIG. 1 is a view of a vibration resistant connector 100 according to some embodiments. In the embodiment shown, connector 100 includes a connector body 110 defining a cavity for housing a contact 102 (e.g., a male or female electrical conductor, an optical fiber, etc.). As shown, the contact 102 may be disposed within an insulator 103 that is housed by the connector body 110. As further shown, connector 100 includes a coupling nut 120 (e.g., a TNC coupling nut) for securing the connector 100 to a corresponding mating connector.

Coupling nut 120 has a first end portion 121 having a hollow cylindrical configuration. The first end portion 121 of coupling nut 120 is disposed around a first end portion 111 of connector body 110 to permit rotation of the coupling nut 120 relative to the connector body 110. That is, the first end portion 111 is disposed in a cavity formed by the end portion 121 of coupling nut 120. Coupling nut 120 has a second end portion 122 also having a hollow cylindrical configuration and further having a threaded inner wall 123 to permit the coupling nut 120 to be securely coupled with an externally threaded mating connector via rotation of the coupling nut. The coupling nut thread 123 can be standard 60 degree thread geometry. In high reliability applications, Stanley's SPIRALOCK® can be used.

Advantageously, a friction member 130 is disposed between the first end portion 121 of coupling nut 120 and the first end portion 111 of connector body 110. In some embodiments, the friction member 130 is resilient and is held in compression between the first end portion 121 of coupling nut 120 and the first end portion 111 of connector body 110. That is, coupling nut 120 imparts an inward, radial force on friction member 130 (i.e., a force in the direction of the axis about with coupling nut 120 is configured to rotate), causing compression of friction member 130.

The friction member 130 has a coefficient of friction effective to reduce the possibility of the coupling nut 120 rotating in a loosening direction due to vibration when the coupling nut is coupled with an externally threaded mating connector while permitting the coupling nut 120 to be rotated by hand. That is, the friction member 130 exerts prevailing torque creating resistance between the connector body 110 and the coupling nut 120, thereby inhibiting free rotation of the coupling nut 120 and hence inhibiting rotation of coupling nut 120 due to vibrations.

In embodiments where the connector 100 is in the form of a Threaded Neill-Concelman (TNC) or threaded coupling nut, the friction member 130 may create a prevailing torque between 4 and 16 in-ozs. That is, as one skilled in the art of connectors would appreciate, in such an embodiment, a torque of at least 4 in-oz. is required to rotate coupling nut 120 with respect to connector body 110 (i.e., around the longitudinal axis of connector body 110), and hence, the friction member 130 prevents coupling nut from freely spinning even before the coupling nut begins to tighten about a threaded mating connector. In embodiments, where connector 100 is in the form of a 3.5 mm connector a Sub-Miniature Version A (SMA) connector, the friction member 130 may be used to create a prevailing torque between 1 and 5 in-oz.

In some embodiments, the friction member 130 includes or consists of a ring-shaped member (e.g., an O-ring). The O-ring may be a rubber O-ring. In such embodiments, an annular groove 140 may be formed in at least one of an outer surface of the first end 11 of the connector body 110 and an inner surface of the first end 121 of the coupling nut 120, and the ring-shaped resilient friction member 130 is disposed within the annular groove.

To address ingress of moisture into the connector 100, in some embodiments, connector 100 further includes a ferrule 180 having a hollow cylindrical configuration and having a first end portion 181, which is disposed around a second end portion 112 of the connector body 110, and a second end portion 182. Ferrule 180 may have a crimp zone 183 between end portions 181 and 182. An O-ring 170 is disposed in an annular groove 142 formed in an outer surface of the second end portion 112 of connector body 110. The first end portion 181 of the ferrule 180 covers and compresses the O-ring. Another O-ring 190 is disposed in an annular groove formed in an inner surface of end portion 182. The crimp zone 183 of ferrule being crimpable between the O-rings 170 and 190 to cause the O-rings 170 and 190 to create a seal between a jacket of a cable (not shown) inserted into the ferrule and connector body.

Figure 2:
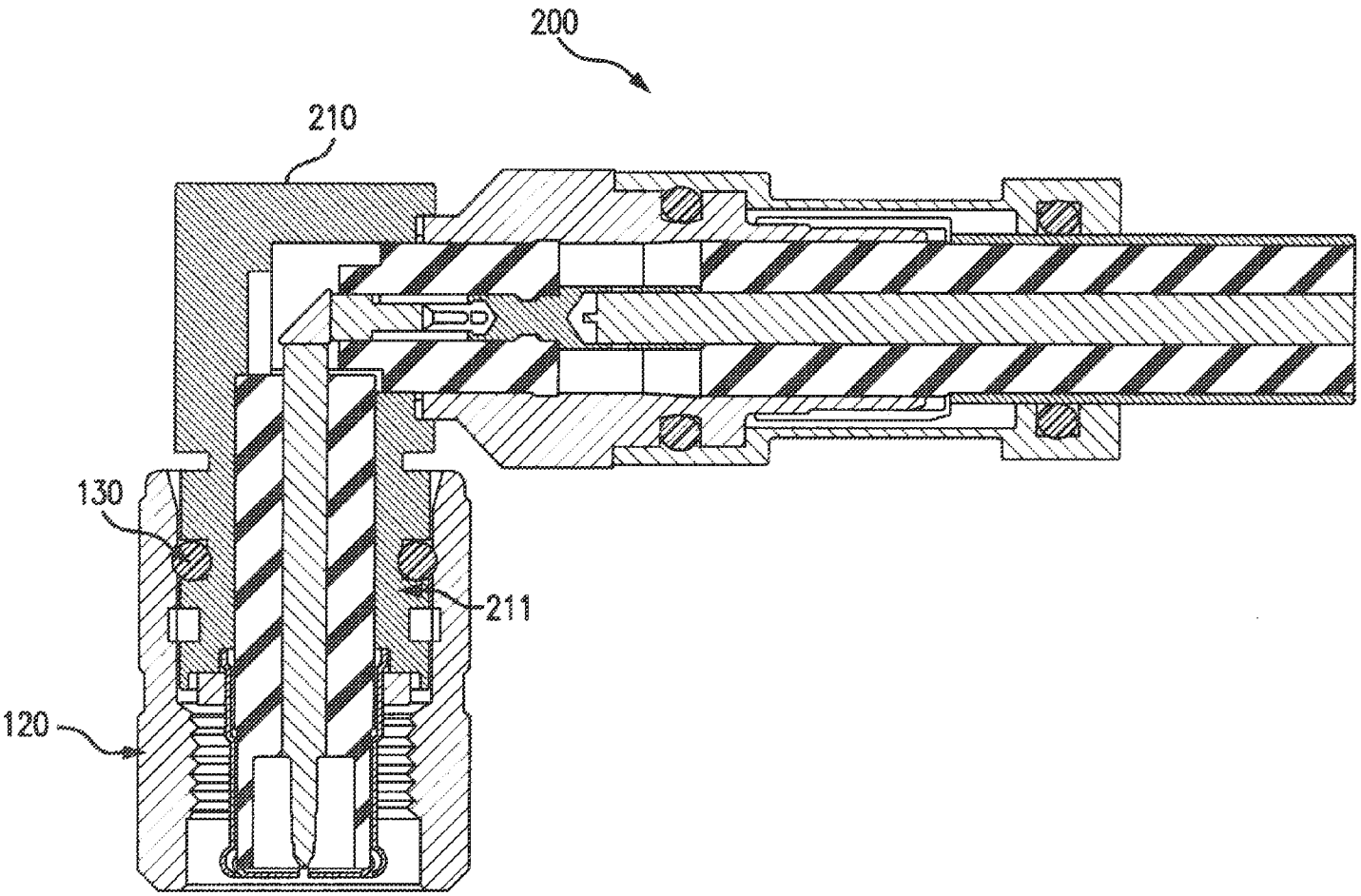
FIG. 2 is a cross-sectional view of a vibration resistant connector according to another embodiment.

FIG. 2 illustrates a right angle connector 200 according another embodiment. Connector 200 is similar to connector 100 in that connector 200 includes coupling nut 120, a connector housing 210 having a first end portion 211 disposed in the cavity formed by end portion 121 of coupling nut 120, and friction member 130 between end portion 121 of coupling nut 120 and end portion 211 of connector body 210. As with the embodiment shown in FIG. 1, friction member may be in the form of an O-ring and disposed in an annular groove formed in an outer surface of end portion 211 of connector body 210 such that the O-ring is compressed radially by the coupling nut 120.

Figure 3:
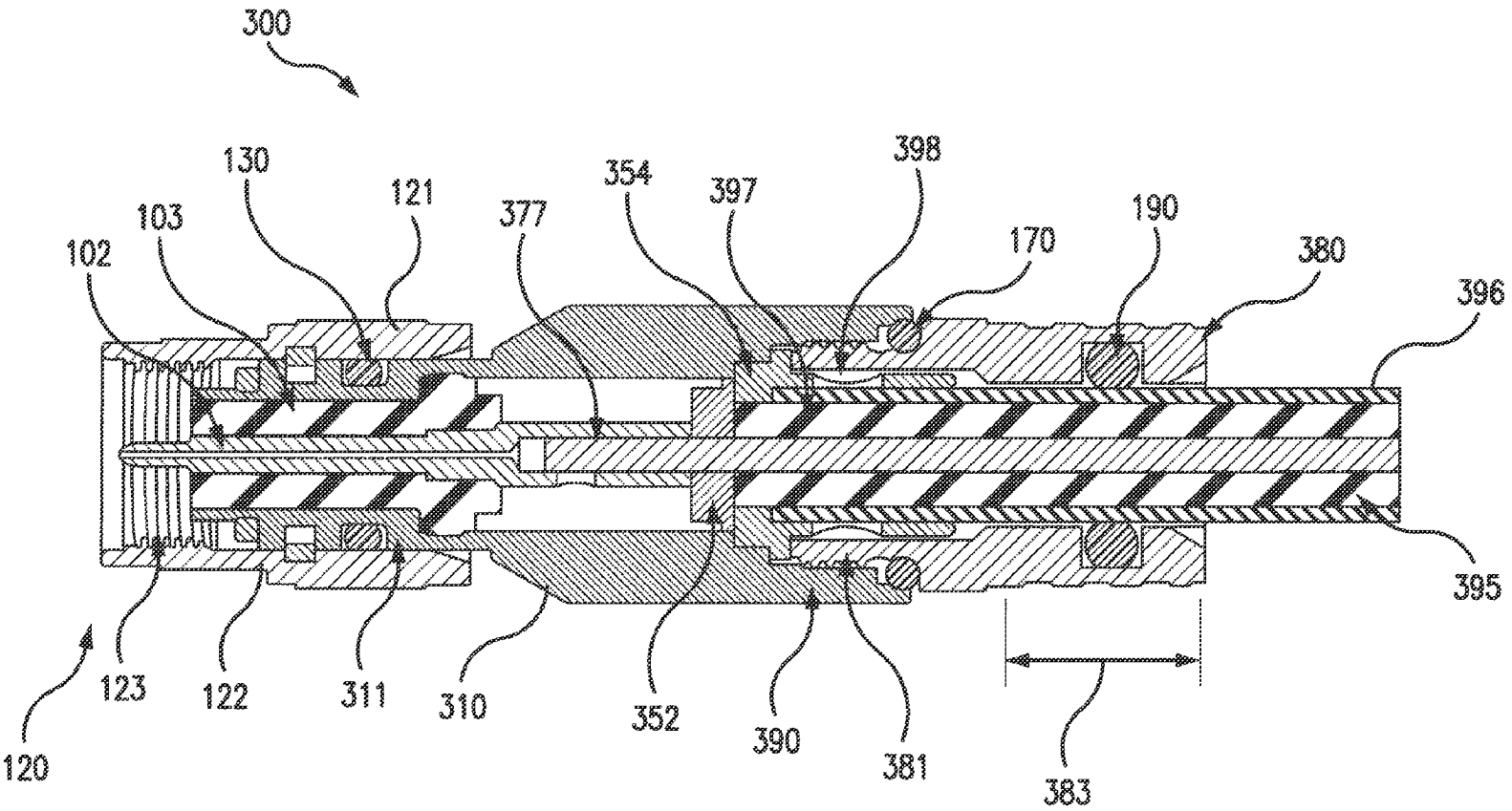
FIG. 3 is a cross-sectional view of a vibration resistant connector according to some embodiments.

FIG. 3 is a view of a vibration resistant connector 300 according to another embodiment. In the embodiment shown, connector 300 includes a connector body 310 defining a cavity for housing contact 102. As shown, the contact 102 may be disposed within an insulator 103 that is housed by the connector body 310. As further shown, connector 300 includes coupling nut 120 for securing the connector 300 to a corresponding mating connector. The first end portion 121 of coupling nut 120 is disposed around a first end portion 311 of connector body 310 to permit rotation of the coupling nut 120 relative to the connector body 310. That is, the first end portion 311 is disposed in a cavity formed coupling nut 120.

Advantageously, friction member 130 is disposed between the first end portion 121 of coupling nut 120 and the first end portion 311 of connector body 310. As in the embodiment of FIG. 1, the friction member 130 is resilient and is held in compression between the first end portion 121 of coupling nut 120 and the first end portion 311 of connector body 310. That is, coupling nut 120 exerts an inward, radial force on friction member 130, which force compresses friction member. Like connector 100, connector 300 may be in the form of: an N-type connector, a TNC connector, an SMA connector, a 3.5 mm connector, etc. Also, as with connector 100, connector 300 may be designed such that the amount of prevailing torque created by friction member 130 may be dependent on whether, for example, connector 300 is a TNC connector or an SMA connector.

Connector 300 further includes a clamp nut 380 having a hollow cylindrical configuration and having a proximal end portion 381 and a crimp zone 383 (e.g., a crimp zone) located at the distal end portion of clamp nut 380. Proximal end portion 381 has a threaded outer wall that mates with a threaded inner wall 390 of connector body 310, thereby coupling clamp nut 380 to connector body 310.

To address ingress of moisture into the connector 300, in some embodiments, an O-ring 170 is disposed in an annular groove formed in connector body 310 directly behind threaded inner wall 390, and an O-ring 190 is disposed in an annular groove formed in an inner surface of crimp zone 383. As shown in FIG. 3, clamp nut 380 is configured to receive via its distal end a coaxial cable 395 and to grip the coaxial cable. For example, when coaxial cable 395 is inserted into clamp nut 380 and crimp zone 383 is 383 is crimped (e.g., crimped using a crimping tool or similar), O-ring 190 exerts an inward radial force on coaxial cable 395 creating a tight seal between O-ring 190 and the outer surface 396 of coaxial cable 395 to inhibit moisture and other matter from entering into the connector 300 via clamp nut 380. Likewise, O-ring 170 functions to create a seal between clamp nut 380 and connector body 310.

Connector 300 further includes a metallic, generally cylindrical, hollow sleeve (a.k.a., "solder sleeve") 354 having open opposite ends. Sleeve 354 is positioned, at least in part, within a cavity formed by connector body 310. Sleeve 354 is configured to receive the proximal end portion 397 of a cable 395 (which in this case is a coaxial cable) and has one or more through holes 398 for receiving melted solder for bonding sleeve 354 with outer surface 396 of cable 395. After the proximal end portion 397 of cable 395 is inserted into sleeve 354 and the sleeve 354 is bonded to cable 395, then the threads of clamp nut 380 are threaded mated with the threads formed in the inner wall of connector body 310. Next, crimp zone 383 is crimped, thereby creating tight seal between O-ring 190 and cable 395.

Connector 300 further includes a dielectric member 352 for matching the impedance of connector 300 with the impedance of cable 395, which may have impedance between 48 and 52 ohms. In the embodiment show, member 352 is sandwiched directly between an end of contact 102 and an end of cable 395 such that member 352 abuts both the end of contact 102 and the end of cable 395. Dielectric member 352 may be constructed from polychlorotrifluoroethylene (PCTFE) or like dielectric.

Figure 4B:
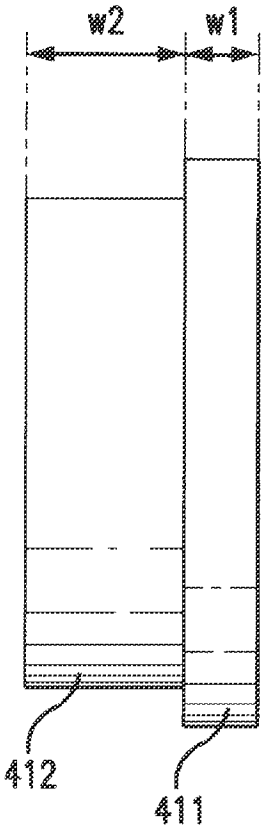
FIGS. 4A and 4B illustrate a dielectric member according to some embodiments.
Figure 4A:
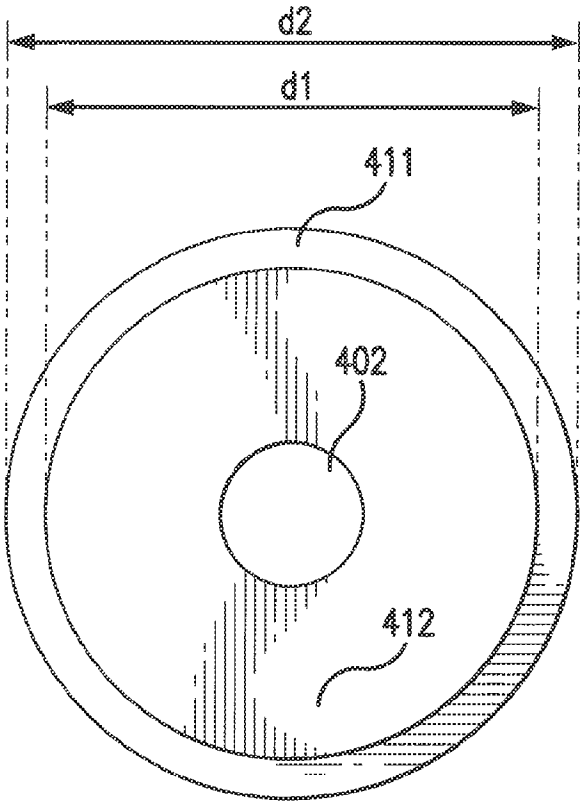

As shown in FIGS. 3, 4A and 4B, in some embodiments, dielectric member 352 has the shape of a top hat. That is, as shown in FIG. 4A, member 352 may have a first circular portion 411 having a first diameter (d1) and second circular portion 412, coaxial with the first circular portion 411, having a second diameter (d2) that is less than d1, and, as shown in FIG. 4B, the width (w1) of the first circular portion 411 is less than the width (w2) of the second circular portion 412. In the example shown, member 352 also has a through hole 402 that goes through the center of member 352, for receiving signal conductor 377 of cable 395. In some embodiments, the dimensions are optimized to match impedance of the coaxial cable. For example, in some embodiments, when cable 395 is has impedance of 52 ohms, it is desirable to configure dielectric member 352 such that it has a lump impedance of 51 ohms. In other embodiments, when cable 395 is has impedance of 48 ohms, it is desirable to configure dielectric member 352 such that it has a lump impedance of 49 ohms.

Figure 5:
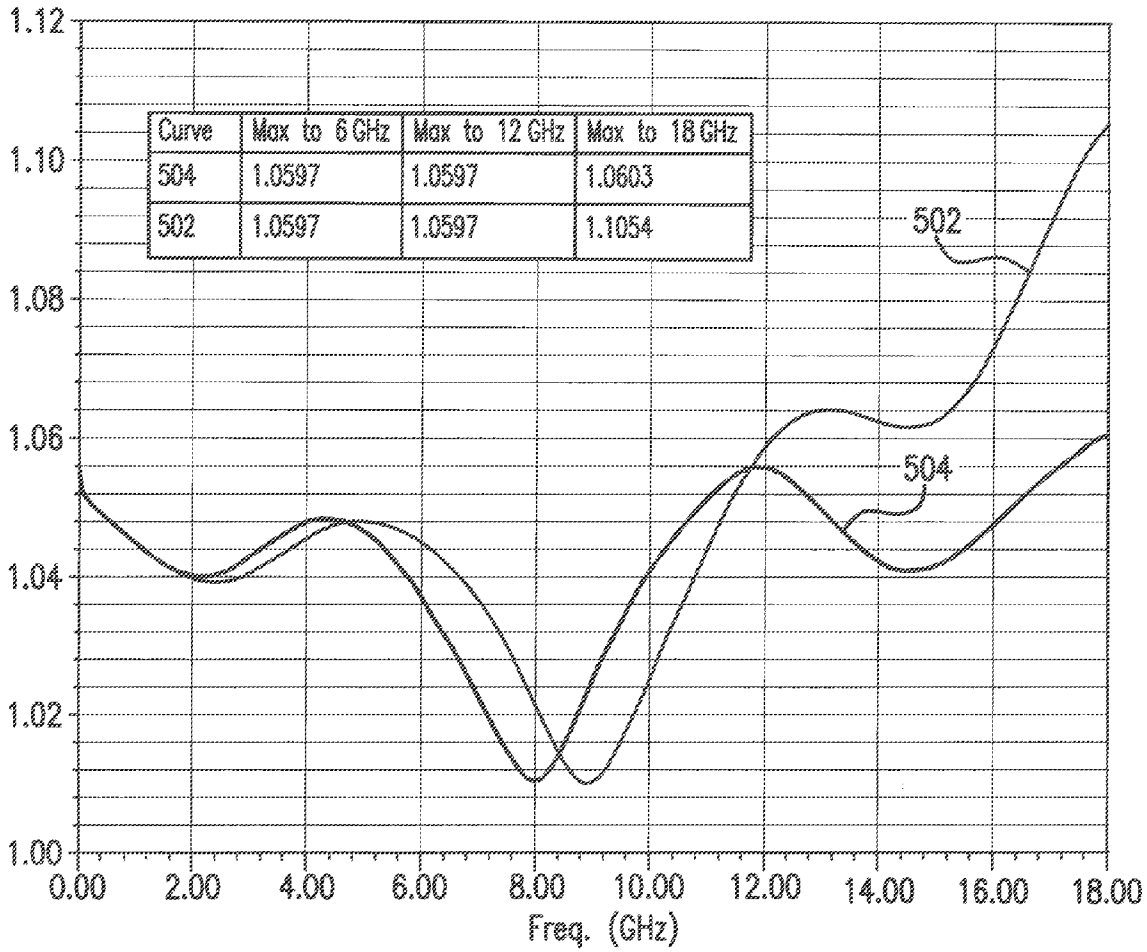
FIG. 5 is a diagram illustrating test results showing the impedance matching efficacy of a dielectric member with 51 ohm impedance.

FIG. 5 shows test results indicating the impedance matching efficacy of a dielectric member 352 having 51 ohm impedance when the cable 395 has 52 ohm impedance. Line 502 shows the measured voltage standing wave ratio (VSWR) when using connector 300 with 50 ohm dielectric member, and line 504 shows the measured VSWR when using connector 300 with 51 ohm dielectric member 352.

While various embodiments have been described above, it should be understood that they have been presented by way of example only, and not limitation. Thus, the breadth and scope of the present disclosure should not be limited by any of the above-described exemplary embodiments. Moreover, any combination of the above described elements in all possible variations thereof is encompassed by the disclosure unless otherwise indicated herein or otherwise clearly contradicted by context.

The invention claimed is:

1. A connector comprising:

a connector body defining a cavity housing a contact;

a coupling nut comprising a first end portion of hollow cylindrical configuration defining a cavity in which a first end portion of said connector body is disposed, wherein the coupling nut is able to rotate relative to said connector body, said coupling nut further including a second end portion of hollow cylindrical configuration with a threaded inner wall for threadedly engaging with an externally threaded mating connector via rotation of the coupling nut; and a resilient friction member disposed in said cavity between said first end portion of said connector body and said first end portion of said coupling nut, said resilient friction member i) being compressed by said coupling nut and ii) creating resistance between the connector body and the coupling nut that prevents free rotation of the coupling nut regardless of whether the threaded inner wall of the coupling nut is threadedly engaged with any externally threaded mating connector.

2. The connector of claim 1, further comprising:

a clamp nut having a hollow cylindrical configuration and having a proximal end portion and a crimp zone located at the distal end portion of clamp nut; and an O-ring disposed in an annular groove formed in an inner surface of crimp zone.

3. The connector of claim 1, wherein said friction member consists of a resilient O-ring.

4. The connector of claim 3, wherein an annular groove is formed in at least one of an outer surface of said first end portion of said connector body and an inner surface of said first end portion of said coupling nut, and wherein said O-ring is disposed within said annular groove.

5. The connector of claim 4, wherein said O-ring is configured to apply a frictional force creating a prevailing torque between about 1 and 16 inch-oz.

6. The connector of claim 1, further comprising a dielectric member for matching the impedance of connector with the impedance of a cable dielectric.

7. The connector of claim 6, wherein the dielectric member is sandwiched directly between an end of the contact and an end of the cable dielectric.

8. The connector of claim 7, wherein the dielectric member is in the shape defined to optimize connector to the impedance of the coaxial cable.

* * * * *